US009034126B2

(12) United States Patent
Krone et al.

(10) Patent No.: US 9,034,126 B2
(45) Date of Patent: May 19, 2015

(54) PYROTECHNIC SMOKE KIT FOR GENERATING A SMOKE SCREEN

(75) Inventors: Uwe Krone, Hamfelde (DE); Klaus Moeller, Reinfeld/Holstein (DE); Kai Ballentin, Moelln (DE)

(73) Assignee: RHEINMETALL WAFFE MUNITION GmbH, Unterleuss (DE)

( * ) Notice: Subject to any disclaimer, the term of this patent is extended or adjusted under 35 U.S.C. 154(b) by 1005 days.

(21) Appl. No.: 12/378,672

(22) Filed: Feb. 18, 2009

(65) Prior Publication Data

US 2009/0211672 A1 Aug. 27, 2009

(30) Foreign Application Priority Data

Feb. 25, 2008 (DE) ..... 10 2008 010 942

(51) Int. Cl.

| | |
|---|---|
| ***C06B 33/14*** | (2006.01) |
| ***C06B 23/00*** | (2006.01) |
| ***C06B 33/04*** | (2006.01) |
| ***C06D 3/00*** | (2006.01) |

(52) U.S. Cl.

CPC ..... *C06B 23/006* (2013.01); *C06B 33/04* (2013.01); *C06B 33/14* (2013.01); *C06D 3/00* (2013.01)

(58) Field of Classification Search

CPC ..... C06B 33/14
USPC ..... 149/41, 70
See application file for complete search history.

(56) References Cited

U.S. PATENT DOCUMENTS

| | | | | |
|---|---|---|---|---|
| H227 | H | 3/1987 | Tracy et al. | |
| H233 | H | 3/1987 | Tracy | |
| 4,968,365 | A * | 11/1990 | Krone | 149/41 |
| 5,154,782 | A | 10/1992 | Shaw et al. | |
| 5,522,320 | A | 6/1996 | Dillehay | |
| 6,558,487 | B1 * | 5/2003 | Tadros | 149/19.1 |
| 6,682,616 | B1 * | 1/2004 | Yamato et al. | 149/45 |
| 7,407,598 | B2 * | 8/2008 | Posson et al. | 252/5 |
| 2004/0108031 | A1 * | 6/2004 | Gast et al. | 149/45 |
| 2006/0113014 | A1 | 6/2006 | Puszynski et al. | |

FOREIGN PATENT DOCUMENTS

| | | |
|---|---|---|
| DE | 37 28 380 | 8/1987 |
| DE | 37289380 C1 | 11/1988 |
| EP | 2093204 A1 | 1/2009 |

OTHER PUBLICATIONS

European Office Action—Dated Sep. 26, 2008.

* cited by examiner

*Primary Examiner* — Aileen B Felton
(74) *Attorney, Agent, or Firm* — Karl F. Milde, Jr.; Eckert Seamans Cherin & Mellott, LLC

(57) ABSTRACT

The pyrotechnic smoke kit for generating a smoke screen comprises a mixture of a light-metal powder as the metallic reduction agent; potassium nitrate and, optionally, potassium perchlorate as the main oxidation agent; at least one carbonate as an additional auxiliary oxidation agent; substances splitting off nitrogen as combustion moderators and at least one sublimable and/or evaporable non-toxic smoke-forming substance. A stabilizer from the group of aliphatic and/or aromatic dicarboxylic acids is added to the mixture of the smoke kit to stabilize the smoke kit. Due to this, the formation of gaseous ammonia in the smoke kit can be prevented.

5 Claims, No Drawings

PYROTECHNIC SMOKE KIT FOR GENERATING A SMOKE SCREEN

BACKGROUND OF THE INVENTION

The invention relates to a pyrotechnic smoke kit for generating a smoke screen.

Such a pyrotechnic smoke kit is known from DE 3728380 C1. The smoke kit is a mixture of a light-metal powder, preferably magnesium powder, as the metallic reduction agent; potassium nitrate or a mixture of potassium nitrate and potassium perchlorate as the main oxidation agent; at least one carbonate, such as calcium carbonate, potassium hydrogen carbonate, sodium hydrogen carbonate, potassium carbonate or sodium carbonate as a further auxiliary oxidation agent; substances splitting off nitrogen as combustion moderators; as well as potassium chloride as sublimable substance and/or a common salt as evaporable non-toxic smoke-forming substance.

Azodicarbonamide, oxamide or dicyandiamide are preferably used as substances splitting off nitrogen.

The mixture of said substances is preferably pressed into a casing at whose end an ignition mixture is provided. The ignition mixture consists substantially of the same components as the smoke kit, however, with the exception of the combustion moderators, but has a changed quantitative composition as is explained in detail in the patent specification.

This known pyrotechnic smoke kit proved its excellent worth. However, it turned out that this mixture is susceptible to corrosion in the case of very long storage times. The metal contained in the smoke kit reacts with water that is present as residual humidity in the smoke kit or originates from the environmental humidity, hydrogen being formed. The released hydrogen reduces the nitrate in the smoke kit to gaseous ammonia which weakens the structure of a smoke body contained in the smoke kit already due to the increase in volume accompanying the formation of gaseous ammonia. After a longer storage time it may happen that the pyrotechnic smoke kit is no longer efficient to an optimum degree.

SUMMARY OF THE INVENTION

The principal object of the present invention is to improve the known smoke kit so that it is efficient to an optimum degree even after a longer storage time.

Surprisingly, it has been found that an admixture of a stabilizer from the group of the aliphatic and/or aromatic dicarboxylic acids to the mixture of the smoke kit contributes to a stabilization of the pyrotechnic smoke kit. Dicarboxylic acids are acids having two carboxyl groups which have a stabilizing effect in the mixture of the pyrotechnic smoke kit.

It has been found that solid ammonium salts are formed in the presence of dicarboxylic acid in the course of a neutralization. The changes in volume of the smoke kit which accompany this are clearly less than those in the formation of gaseous ammonia so that the structure of the smoke kit is not influenced and the smoke kit as a whole is stabilized.

A low percentage of the dicarboxylic acids must be added to the mixture of the pyrotechnic smoke kit; this share is essentially in the range of from 0.1 to 5% by weight.

Oxalic acid, malonic acid, succinic acid, adipic acid or sebacic acid and/or a mixture of these substances are/is preferably used as aliphatic dicarboxylic acids.

Phthalic acid or terephthalic acid or a mixture of these substances are/is preferably used as aromatic dicarboxylic acids.

The mentioned aliphatic and/or aromatic dicarboxylic acids chemically stabilize the mixture of the pyrotechnic smoke kit so that no ammonia is formed and the mixture of the smoke kit can be stored for a long period of time without its operativeness being impaired.

Pyrotechnic smoke kits of the type in question here are customarily pressed into a casing and covered with an ignition mixture, which pyrotechnically ignites the smoke kit when it is used.

In order to physically stabilize the mixture of the smoke kit, a binding agent may be added to the mixture of the smoke kit according to the invention, which is selected from the group of the halogen-free thermoplastics. The binding agent is e.g. a polyvinyl acetate, polyvinyl alcohol, polyvinyl butyral, polyvinyl ester or polyvinyl ether.

EXAMPLE

The mixture for a pyrotechnic smoke kit according to the invention preferably contains proportionately:

| | |
|---|---|
| magnesium powder (Mg) as the reduction agent | 10-25% |
| potassium nitrate ($KNO_3$) | 20-36% |
| potassium perchlorate ($KClO_4$) | 0-15%, |

potassium nitrate and/or potassium perchlorate serving as the main oxidation agent, at least one carbonate such as calcium carbonate ($CaCO_3$), potassium hydrogen carbonate ($KHCO_3$), sodium hydrogen carbonate ($NaHCO_3$), potassium carbonate ($K_2CO_3$) and/or sodium carbonate ($Na_2CO_3$) in a share of 12-30%, the mentioned carbonates serving as further oxidation agents, potassium chloride (KC1) and/or common salt (NaCl) as smoke-forming substances 20-50% aliphatic and/or aromatic dicarboxylic acids 0.1-5%.

The percentage figures are all in percent by weight.

Azodicarbonamide, oxamide and/or dicyandiamide are preferably used as substances splitting off nitrogen in a share of 5-20%.

A binding agent from the group of the halogen-free thermoplastics can still be used for the physical stabilization of the mixture of the pyrotechnic smoke kit, the binding agent preferably being polyvinyl acetate, polyvinyl alcohol, polyvinyl butyral, polyvinyl ester or polyvinyl ether.

There has thus been shown and described a novel pyrotechnic smoke kit for generating a smoke screen which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. In a pyrotechnic smoke kit for generating a smoke screen comprising a composition mixture of a light-metal powder as a metallic reduction agent, potassium nitrate and, optionally, potassium perchlorate as the main oxidation agent and at least one carbonate as an additional auxiliary oxidation agent, as well as substances splitting off nitrogen and at least one sublimable or evaporable non-toxic smoke-forming substance, the improvement wherein said composition includes dicarboxylic acids selected from the group consisting of aliphatic and aromatic dicarboxylic acids as a stabilizer, having a percent by weight share in the range of from 0.1 to 5%, for inhibiting the formation of gaseous ammonia.

2. The smoke kit according to claim 1, wherein the aliphatic dicarboxylic acids are selected from the group consisting of oxalic acid, malonic acid, succinic acid, adipic acid, sebacic acid and a mixture of these acids.

3. The smoke kit according to claim 1, wherein the aromatic dicarboxylic acids are selected from the group consisting of phthalic acid, terephthalic acid and a mixture of these acids.

4. The smoke kit according to claim 1, wherein said mixture further includes a binding agent selected from the group consisting of the halogen-free thermoplastics for physically stabilizing the composition.

5. The smoke kit according to claim 4, wherein the binding agent is selected from the group consisting of polyvinyl acetate, polyvinyl alcohol, polyvinyl butyral, polyvinyl ester and polyvinyl ether.

* * * * *